US006263175B1

(12) United States Patent
Sawada et al.

(10) Patent No.: US 6,263,175 B1
(45) **Date of Patent: *Jul. 17, 2001**

(54) IMAGE FORMING APPARATUS INCLUDING A CHARGING DEVICE WITH A CLEANING MEMBER

(75) Inventors: Akira Sawada, Setagaya-ku; Masumi Sato, Yokohama, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/408,439

(22) Filed: Sep. 29, 1999

(30) Foreign Application Priority Data

Sep. 30, 1998 (JP) ..... 10-277928
Aug. 26, 1999 (JP) ..... 11-239809

(51) Int. Cl.[7] ..... G03G 15/02
(52) U.S. Cl. ..... 399/100; 399/176
(58) Field of Search ..... 399/100, 101, 399/174, 176

(56) References Cited

U.S. PATENT DOCUMENTS 5,610,691 * 3/1997 Takahashi et al. ..... 399/176
5,799,229 8/1998 Yokoyama et al. ..... 399/100

FOREIGN PATENT DOCUMENTS 5-313527 11/1993 (JP) .
7-49605 2/1995 (JP) .
8-305129 11/1996 (JP) .
9-114202 * 5/1997 (JP) .
10-186812 7/1998 (JP) .

* cited by examiner

*Primary Examiner*—Joan Pendegrase
(74) *Attorney, Agent, or Firm*—Oblon, Spivak, McClelland, Maier & Neustadt, P.C.

(57) ABSTRACT

An image forming apparatus including a rotatable member configured to bear an image, a charging member configured to charge a surface of the rotatable member, and a cleaning member in sliding contact with a surface of the charging member. The surface of the cleaning member includes convex portions which engage with convex portions on a surface of the charging member so as to clean the surface of the charging member. Further, the surface of the charging member includes a surface roughness having a directivity set to a forward direction relative to a rotating direction of the rotatable member and set to a backward direction relative to the surface of the cleaning member.

54 Claims, 6 Drawing Sheets

IMAGE FORMING APPARATUS INCLUDING A CHARGING DEVICE WITH A CLEANING MEMBER

BACKGROUND OF THE INVENTION

1. Field of the Invention

The present invention relates to an image forming apparatus, and more particularly to an image forming apparatus including a charging device in which a cleaning member slidably contacts a surface of the charging device so as to clean the surface thereof.

2. Discussion of the Background

In an image forming apparatus, such as a copying machine, a printer, a facsimile machine, or the like, it is desired a photoconductive element, a developing device, a charging device, etc. are compact to reduce the total size of the image forming apparatus.

Many charging devices employ a charging roller, which uniformly charges a surface of the photoconductive element by applying a voltage to the charging roller. Further, the charging roller contacts the photoconductive element. Typically, in such a charging device, a roller cleaning member made of, for example, a sponge or the like, slidably contacts a surface of the charging roller with an appropriate pressure. When the charging roller contacting the photoconductive element is rotated, the roller cleaning member scrapes foreign substances, such as toner and paper powder, from the surface of the charging roller.

Generally there are two types of roller cleaning members. A first type constantly contacts the surface of the charging roller, and is called a "constant contact type roller cleaning member." The second type contacts the surface of the charging roller only when needed, and is called a "contact/separate type roller cleaning member."

One advantage of the contact/separate type roller cleaning member is that when the contact/separate type roller cleaning member contacts the charging roller, the contact/separate type roller cleaning member makes an impact on foreign substances, such as toner and paper powder which adhere to the surface of the charging roller. Thus, because of the impact from the contact/separate type roller cleaning member, the foreign substances are easily dropped from the surface of the charging roller.

However, because the contact/separate type roller cleaning member requires an additional mechanism so it can contact and separate from the surface of the charging roller, the contact/separate type roller cleaning member tends to be large in size. Therefore, because the image forming apparatus is required to be compact, the contact/separate type roller cleaning member is unfavorable.

On the contrary, the constant contact type roller cleaning member does not require an additional mechanism to contact and separate from the surface of the charging roller. Therefore, the constant contact type roller cleaning member is more compact.

However, the constant contact type roller cleaning member does not make an impact on foreign substances which adhere to the surface of the charging roller. Further, when the foreign substances have the property of a glass transition and when image forming operations are performed to more than 5,000 sheets, the foreign substances are likely to be fused on the surface of the charging roller by the frictional heat produced between the charging roller and the roller cleaning member.

When the foreign substances are fused on the surface of the charging roller, the charging roller cannot perform a charging function on the fused parts thereof. As a result, a black line occurs on a sheet at every pitch corresponding to the circumferential length of the charging roller in a so-called negative-to-positive developing method. Therefore, an image quality is significantly reduced.

For the above-described reasons, the constant contact type roller cleaning member is considered to be unfavorable for practical use and is not often used, even though the roller cleaning member can be made more compact.

SUMMARY OF THE INVENTION

Accordingly, one object of the present invention is to solve the above-noted and other problems.

Another object of the present invention is to provide a constant contact type roller which effectively cleans a charging member, and is compact in size.

These and other objects of the present invention are achieved by providing a novel image forming apparatus, including a rotatable member configured to bear an image, a charging member configured to charge a surface of the rotatable member, and a cleaning member in sliding contact with a surface of the charging member and configured to clean the surface of the charging member. Further, a surface of the cleaning member includes convex portions which engage with convex portions on a surface of the charging member. Further, the surface of the charging member includes a surface roughness having a directivity set to a forward direction relative to a rotating direction of the rotatable member and set to a backward direction relative to the surface of the cleaning member. The present invention also provides a method of cleaning a charging member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 4:
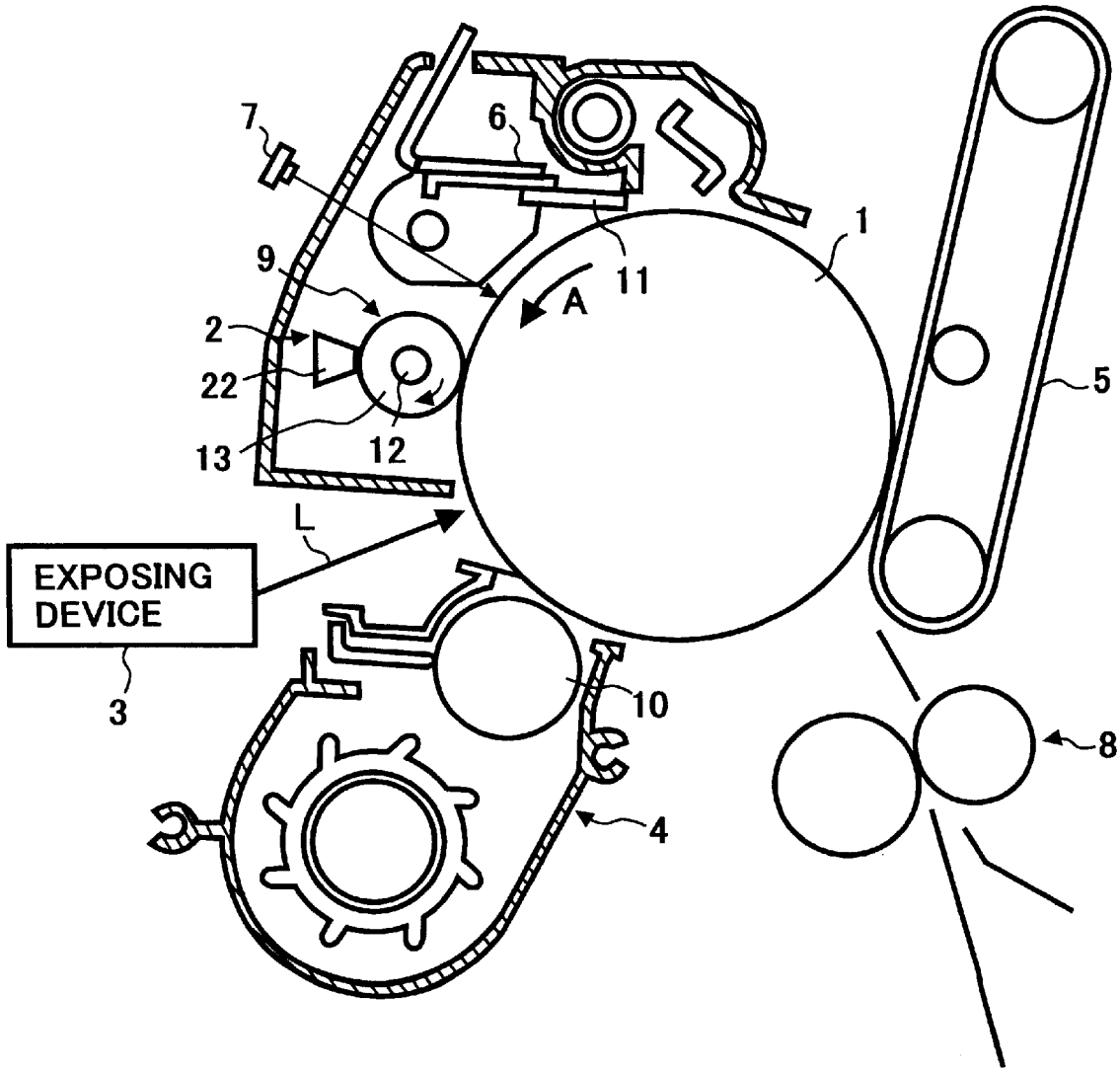
FIG. 4 is a schematic view illustrating an image forming section of the image forming apparatus of the present invention.

Referring now to the drawings, wherein like reference numerals designate identical or corresponding parts throughout the several views, FIG. 4 illustrates an image forming apparatus including a drum-shaped photoconductive element (i.e., charged member) 1 capable of being rotated in a direction indicated by an arrow A. A charging device 2 including a charging member, such as a charging roller 9, is provided around the photoconductive element 1 to uniformly charge a surface of the photoconductive element 1 by application of a voltage supplied from a power source (not shown). The charging roller 9 is kept in contact with the surface of the photoconductive element 1 and is rotated by a rotation movement of the photoconductive element 1. Also provided around the photoconductive element 1 is an exposing device 3 that forms an electrostatic latent image on the photoconductive element 1 by illuminating a laser light L, and a developing apparatus 4 that develops the electrostatic latent image into a visible toner image.

Also provided around the photoconductive element 1 is a transfer belt 5 that transfers a toner image formed by the developing apparatus 4 onto a transfer sheet, a cleaning device 6 that removes residual toner remaining on the photoconductive element 1 after the toner image is transferred onto the transfer sheet, and a discharging lamp 7 that removes residual charge on the photoconductive element 1. In addition, toner is supplied to the developing apparatus 4 from an inlet by a toner supplying apparatus (not shown).

When an image forming operation starts, the photoconductive element 1 is rotated in the direction indicated by the arrow A. Then, the surface of the photoconductive element 1 is discharged with a discharging light emitted from the discharging lamp 7 and the surface potential of a discharged part of the photoconductive element 1 is equalized to a standard voltage of 0V to −150V. Then, the photoconductive element 1 is charged by an application of a voltage to the charging roller 9 contacting the surface of the rotating photoconductive element 1. Thus, the surface potential of the photoconductive element 1 is charged to a voltage of approximately −1,000V.

A laser light L is emitted from the exposing device 3 to the charged surface of the photoconductive element 1. Therefore, by the illumination of the laser light L, the surface potential of an image part of the surface of the photoconductive element 1 is charged to a voltage of approximately 0V to −200V. Accordingly, the toner on a developing sleeve 10 of the developing apparatus 4 is attracted to the image part on the photoconductive element 1. Then, the toner image formed on the photoconductive element 1 moves to a transfer station where the photoconductive element 1 contacts the transfer belt 5 by the rotation of the photoconductive element 1 in a direction indicated by the arrow A.

A transfer sheet is fed from a sheet feeding section (not shown) and is conveyed by a pair of registration rollers 8, such that a leading edge of the transfer sheet reaches the transfer station at a timing in alignment with a leading edge of the toner image formed on the photoconductive element 1. Then, the transfer sheet is conveyed to a fixing section (not shown) and the toner image is melted and fixed thereupon by application of heat and pressure. Thereafter, the transfer sheet is discharged to a sheet discharging tray (not shown). The residual toner remaining on the photoconductive element 1 after the transfer operation is scraped off from the surface of the photoconductive element 1 by a cleaning blade 11 of the cleaning device 6 and the surface of the photoconductive element 1 is discharged by the discharging lamp 7. Thereafter, the image forming process may be repeated.

The charging device 2 will now be explained in more detail.

The charging roller 9 of the charging device 2 includes a conductive rubber 13 having a low moisture absorbency and a stable resistance. The conductive rubber 13 is formed around a circumference of a metal made shaft 12 except at both end parts of the shaft 12. A surface layer may additionally be formed on the surface of the conductive rubber 13. Further, the surface of the conductive rubber 13 constantly contacts the surface of the photoconductive element 1 with pressure such that the charging roller 9 is rotated by a rotation movement of the photoconductive element 1. The surface of the photoconductive element 1 is uniformly charged upon application of a high voltage to the shaft 12 of the charging roller 9.

A roller cleaning member 22 is constantly in pressure contact with a surface of the charging roller 9. The roller cleaning member 22 is formed of, for example, a foam, such as a sponge or the like, and is adhered to a cleaning pad supporting member (not shown) with, for example, a double-sided adhesive tape or the like. In addition, the surface of the charging roller 9 is soiled with toner transferred from the photoconductive element 1 due to the constant pressure contact with the rotating photoconductive element 1. This tends to cause a charging unevenness. Therefore, the roller cleaning member 22 removes the toner adhered on the surface of the charging roller 9, and thereby the charging unevenness caused by the soiling of the charging roller 9 is typically prevented.

Figure 2:
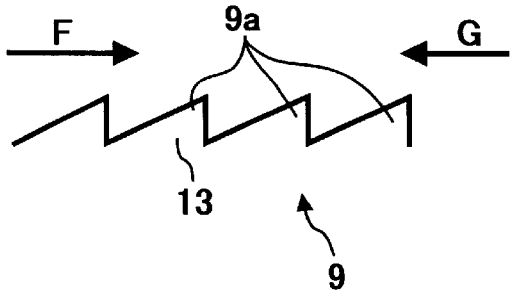
FIG. 2 is an enlarged schematic view illustrating convex portions on a surface of the charging roller.

The charging roller 9 may be formed into a roller shape with a rubber molding, and then shaped so as to have a desired straightness and a predetermined surface roughness with a grinding process and a burnishing process, for example. In the grinding and burnishing processes convex portions 9*a*, as illustrated in FIG. 2, may be formed on the surface of the charging roller 9 such that each convex portion 9*a* slants at a certain angle relative to a direction perpendicular to the surface of the charging roller 9. A slanting direction of the convex portions 9*a* is hereinafter called a "direction of convex portions."

Figure 1:
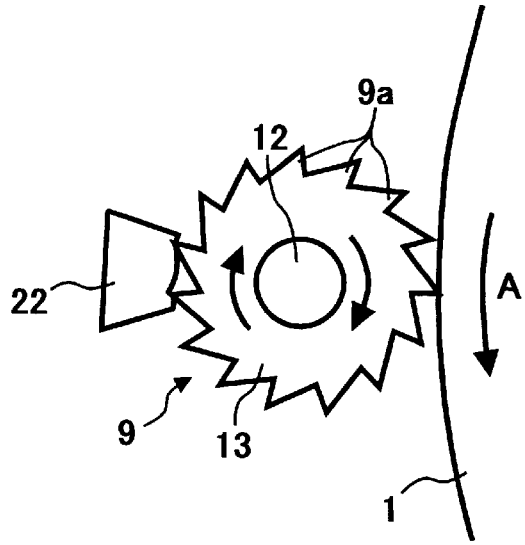
FIG. 1 is an exaggerated diagrammatic view illustrating a directivity of a roughed surface of a charging roller in relation to a surface of a photoconductive element and a roller cleaning member.
Figure 3:
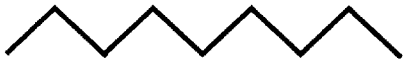
FIG. 3 is a schematic view illustrating a shape of a roughed surface of the charging roller, in which the roughed surface of the charging roller is formed without having a directivity.

The direction of the convex portions 9*a* (i.e., the directivity of the surface roughness of the charging roller 9) is set to a forward direction (i.e., a direction causing a smaller sliding frictional resistance between the charging roller 9 and the surface of the photoconductive element 1) relative to the rotating direction of the photoconductive element 1 indicated by the arrow A. Further, the direction of convex portions 9*a* is set to a backward direction (i.e., a direction causing a larger sliding frictional resistance between the charging roller 9 and the roller cleaning member 22) relative to the contact direction with the roller cleaning member 22 as illustrated by a diagrammatic view in FIG. 1. In FIG. 2, the above-described forward and backward directions are respectively indicated by arrows F and G. For comparison, FIG. 3 illustrates a surface roughness that is not provided with a directivity.

Referring now to FIGS. 5 through 8, a mechanism of removing foreign substances, such as toner and paper powder adhered to the surface of the charging roller 9 in the image forming apparatus of this invention, is explained. FIGS. 5 through 8 are explanatory views in which a contact part between the charging roller 9 and the roller cleaning member 22 is enlarged. For the sake of clarity, the charging roller 9 is illustrated horizontally in FIGS. 5 through 8.

Figure 5:
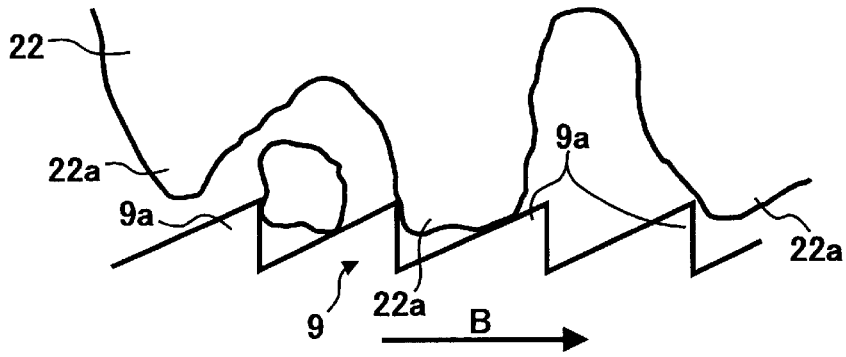
FIG. 5 is an enlarged view illustrating a condition in which the charging roller rotates such that the direction of the convex portions is a backward direction relative to the roller cleaning member.
Figure 6:
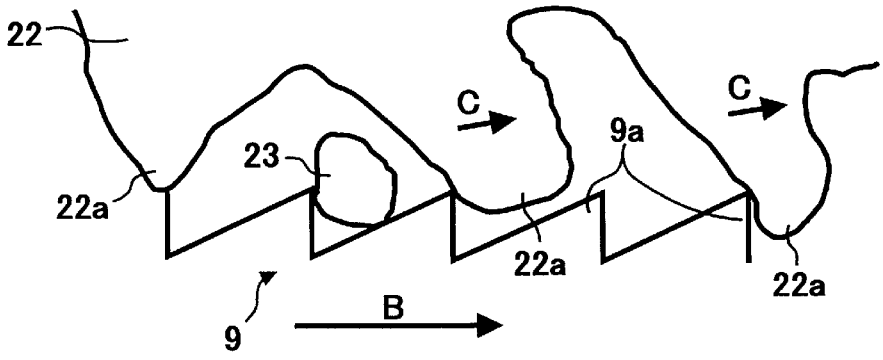
FIG. 6 is an enlarged view illustrating a condition in which convex portions of the surface of the roller cleaning member is engaged and deformed with convex portions of the charging roller.

As illustrated in FIG. 5, the rotating direction of the charging roller 9 (i.e., the rotating direction indicated by an arrow B) is set such that the direction of convex portions 9*a* of the charging roller 9 is a backward direction relative to the roller cleaning member 22. Therefore, when the charging roller 9 is rotated in the direction indicated by the arrow B in FIG. 5, convex portions 22*a* of the surface of the roller cleaning member 22 are caught by and engaged with convex portions 9*a* of the charging roller 9. Then, as illustrated in FIG. 6, the convex portions 22*a* of the roller cleaning member 22 are deformed in the direction indicated by an arrow C. When the convex portions 22*a* of the roller cleaning member 22 are deformed to a certain degree, the convex portions 22*a* become disengaged from the convex portions 9*a* and returns to an original position due to its elasticity as illustrated in FIG. 5.

Figure 7:
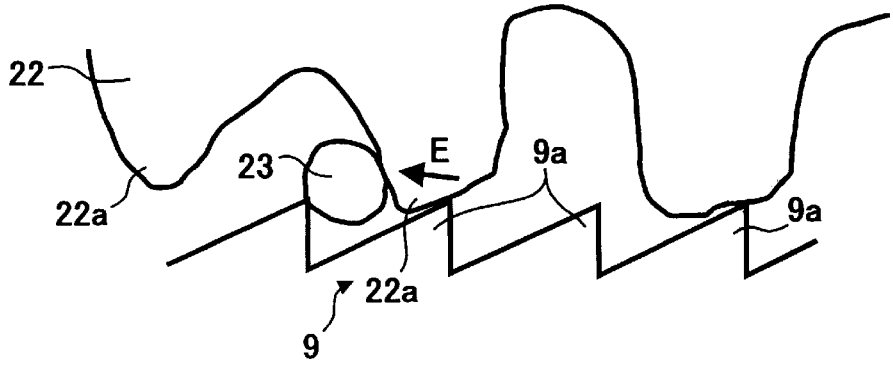
FIG. 7 is an enlarged view illustrating a condition in which the convex portions of the roller cleaning member hits against a foreign substance on the charging roller and then returns to an original portion.
Figure 8:
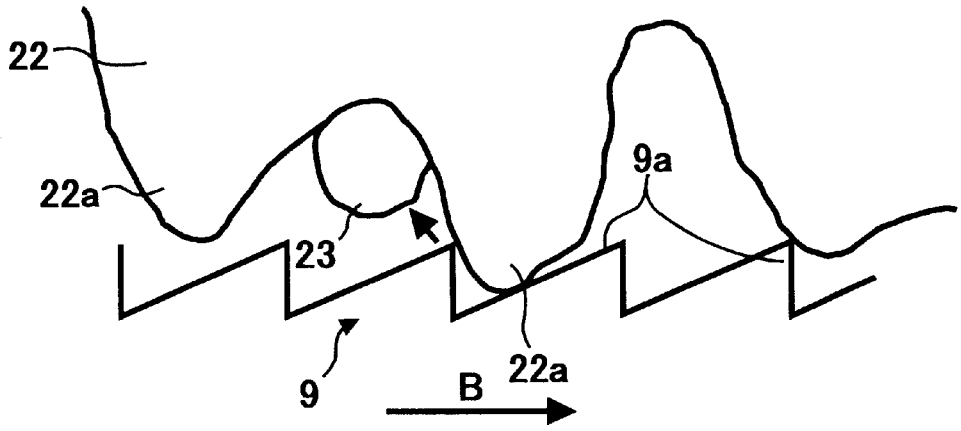
FIG. 8 is an enlarged view illustrating a condition in which the foreign substance leaves the surface of the charging roller by the hitting force of the convex portions of the surface of the roller cleaning member.

When the convex portions 22*a* of the roller cleaning member 22 hits against foreign substance 23, such as toner and paper powder while returning to the original position as illustrated in FIG. 7, the foreign substance 23 is forcibly removed from the surface of the charging roller 9 by the hitting force of the convex portions 22*a*, which acts in the direction indicated by an arrow E. Further, as illustrated in FIG. 8, the foreign substance 23 separates from the surface of the charging roller 9.

The above-described removal of the foreign substance 23 attached to the surface of the charging roller 9 by the convex portions 22*a* of the surface of the roller cleaning member 22 is enabled by the above-described characteristics of the charging roller 9*a*. That is, the surface of the charging roller 9 has a surface roughness having a directivity (i.e., convex portions 9*a* are formed on the surface of the charging roller 9) and the direction of convex portions 9*a* is set to a backward direction relative to the contact direction with the roller cleaning member 22.

Figure 9:
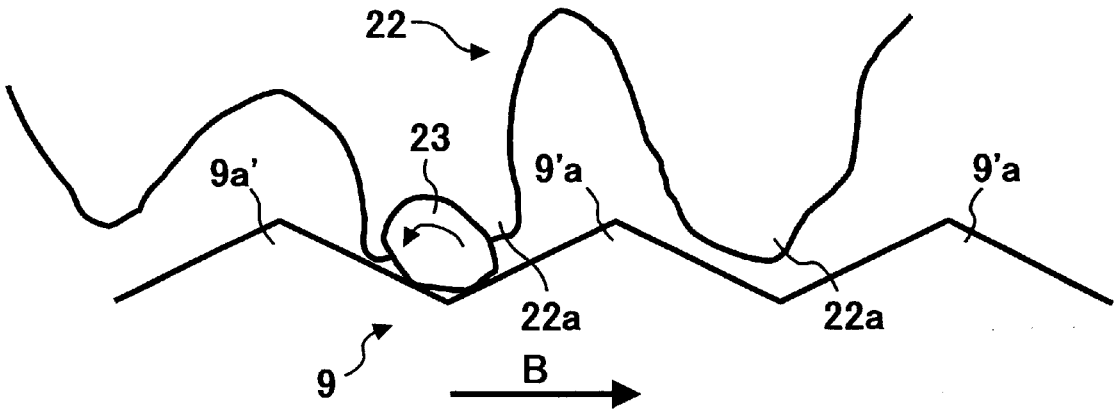
FIG. 9 PRIOR ART
FIG. 9 is an enlarged view illustrating a background charging roller having a surface roughness that is not provided with a directivity.

FIG. 9 illustrates a background charging roller 9' whose surface is covered with a resin coating. The background charging roller 9' has a surface roughness that is not provided with the directivity. Therefore, even though a convex portion 9*a*' of the charging roller 9' moves in the direction indicated by an arrow B by the rotation of the charging roller 9', the convex portion 22*a* of the surface of the roller cleaning member 22 is not deformed like the case explained in FIG. 6. This is because the convex portion 9*a*' of the charging roller 9' is not set to a backward direction relative to the surface of the roller cleaning member 22 and the convex portion 22*a* is not caught by the convex portion 9*a*' of the charging roller 9'.

Therefore, a hitting force causing the removal of foreign substance 23 from the surface of the charging roller 9' is not produced in the convex portion 22*a* of the roller cleaning member 22. As a result, as illustrated in FIG. 9, the foreign substance 23 between the convex portions 9*a*' is sandwiched between the surface of the charging roller 9' and the roller cleaning member 22 and remains and rolls therebetween.

After the convex portion 22*a* of the roller cleaning member 22 passes over the align substance 23 without removing it from the surface of the charging roller 9', the foreign substance 23 is fused on the surface of the charging roller 9' due to the pressure caused when the foreign substance 23 is sandwiched between the photoconductive element 1 and the surface of the charging roller 9'.

On the other hand, in the image forming apparatus of the present invention, the convex portions 22*a* of the roller cleaning member 22 repeatedly engage and disengage with the convex portions 9*a* of the charging roller 9 while the charging roller 9 rotates, as described in FIGS. 5 through 8. As a result, the foreign substance 23 is not fused to the surface of the charging roller 9 due to the hitting force of the convex portions 22*a* of the roller cleaning member 22 to the foreign substance 23.

EXAMPLE

The charging roller used in this example includes a nickel-plated metal shaft (SUM22) with a 6 mm diameter. The conductive rubber (e.g., an epichloro hydorin rubber) is formed around the circumference of the nickel-plated metal shaft. After grinding the conductive rubber to have a 14 mm diameter, the surface of the conductive rubber is impregnated with a solution of compound containing isocyanate and is heated.

The surface hardness of the above-described charging roller is measured to be 52 by an "Asker C" method (i.e., a method of measuring the hardness). In this example, the surface hardness of the charging roller may range between 30 and 70. Further, the density of a convex portions of the above-described charging roller is measured to 75 pcs/25 mm. In this example, the above-described density may range from 60 pcs to 90 pcs/25 mm.

Several types of charging rollers, in which the surface is finished with grinding so that the surface roughness is set to about 2 $\mu$m to 50 $\mu$m in a ten-point mean surface roughness (Rz) scale, which is prescribed in JIS (Japanese Industrial Standards), are used for image reproduction tests in this example.

The roller cleaning member used in the example includes a sponge, such as one sold under the trademark SM55 made by INOAC Corporation. Further, the roller cleaning member is formed to a rectangular solid of 6 mm (height)×5 mm (width)×318 mm (length) and is adhered to a cleaning pad supporting member with a double-sided adhesive tape. The sponge SM55 is provided such that its edge abuts the surface of the charging roller. Further, the above-described cleaning pad supporting member is provided with the main body of the image forming apparatus such that the cleaning pad supporting member swings in a direction longitudinally of the charging roller by a 4 mm swing width. Thereby, the concentration of soiling by toner and paper powder on a part in the direction longitudinally of the roller cleaning member is typically avoided.

Further, the average height of the convex portions (i.e., the depth of the concave portion) of the surface of the roller cleaning member is measured to be 750 μm. In this example, the above-described average height of the convex portion may range between 500 μm and 1000 μm. Therefore, in this example, the average height of the convex portions of the surface of the roller cleaning member is set to be greater than the surface roughness of the charging roller in the ten-point mean surface roughness (Rz) scale.

Furthermore, the hardness of the SM55 sponge of the roller cleaning member is measured to be 10 by the "Asker C" method. In this example, the hardness of the sponge may range between 5 and 30. Therefore, in this example, the surface hardness of the charging roller is set to be greater than the hardness of the sponge of the roller cleaning member.

In addition, a cell density of the sponge of the roller cleaning member is measured to 55 pcs/25 mm. In this example, the cell density may range from 20 pcs to 60 pcs/25 mm. Therefore, in this example, the cell density of the sponge of the roller cleaning member is set to be lower than the density of the convex portions of the charging roller.

Image reproduction tests were performed on 50,000 sheets in the image forming apparatus with the charging roller and roller cleaning member which have the above-described characteristics. The evaluation of the tests is performed by visually evaluating background fouling due to foreign substances on the charging roller and blurred images caused by a slip of the charging roller on the photoconductive element due to an excessive frictional resistance between the roller cleaning member and charging roller. The evaluation includes 5 ranks. A rank 1 is the worst case and a rank 5 is the best case. A rank 4 or above is considered to be a satisfactory level.

Figure 10:
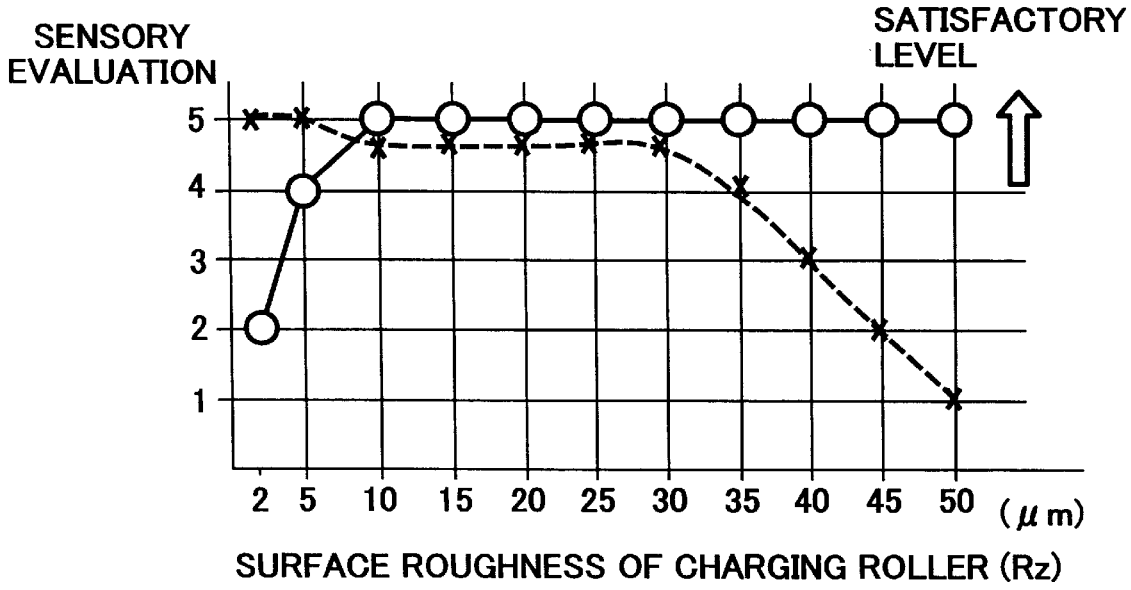
FIG. 10 is a graph illustrating a result of an experiment of background fouling and blurred image using several kinds of charging rollers having different surface roughness with directivity.

A result of the experiment will be explained with reference to FIG. 10. A solid line in the graph indicates the result of the evaluation of the background fouling due to foreign substances on the charging roller, and a broken line in the graph indicates the result of the evaluation of the blurred images caused by a slip of the charging roller on the photoconductive element.

According to the result of the experiment, the background fouling due to foreign substances on the charging roller occurs frequently, when the ten-point mean surface roughness (Rz) of the charging rollers is 2 μm. This is because a vibration of the convex portions of the surface of the roller cleaning member is not enough to remove the foreign substances from the charging roller, so that black lines frequently occur. However, when the ten-point mean surface roughness (Rz) of the charging roller becomes 5 μm or greater, the vibration of the surface of the convex portions of the roller cleaning member is enough to remove the foreign substances from the charging roller, and the evaluation of a resultant background fouling is ranked at rank 4 or above (i.e., a satisfactory level).

On the other hand, when the ten-point mean surface roughness (Rz) of the charging roller is higher than 35 μm, the friction between the roller cleaning member and the charging roller becomes excessive and blurred images caused by a slip of the charging roller on the photoconductive element occurs in a halftone image. As a result, the evaluation of a resultant blurred image is ranked at an unsatisfactory level.

According to the result of the experiment as described above, even when a roller cleaning member is a constant contact type, both the background fouling due to foreign substances on the charging roller and the blurred images caused by a slip of the charging roller on the photoconductive element can be prevented from occurring, in the case the charging roller is configured such that the directivity of the surface roughness is set to a backward direction relative to the surface of the cleaning member, and the surface roughness of the charging roller is set to about 5 μm to 35 μm in the ten-point mean surface roughness (Rz).

In addition, the charged member of the above-described embodiment and example is not limited to the drum shaped photoconductive element, but other charged members may be applicable, such as a belt type photoconductive element, a dielectric drum, and the like.

Further, the above-described charging member is not limited to the charging roller, but a charging belt including a belt shaped conductive rubber may be applicable.

Also, although a contact type charging member in which the charging roller 9 as a charging member charges the photoconductive element 1 as a charged member in contact as illustrated in FIG. 4, a separate type charging member may be applicable if the charging member and charged member are provided 300 μm or less apart.

Figure 11A:
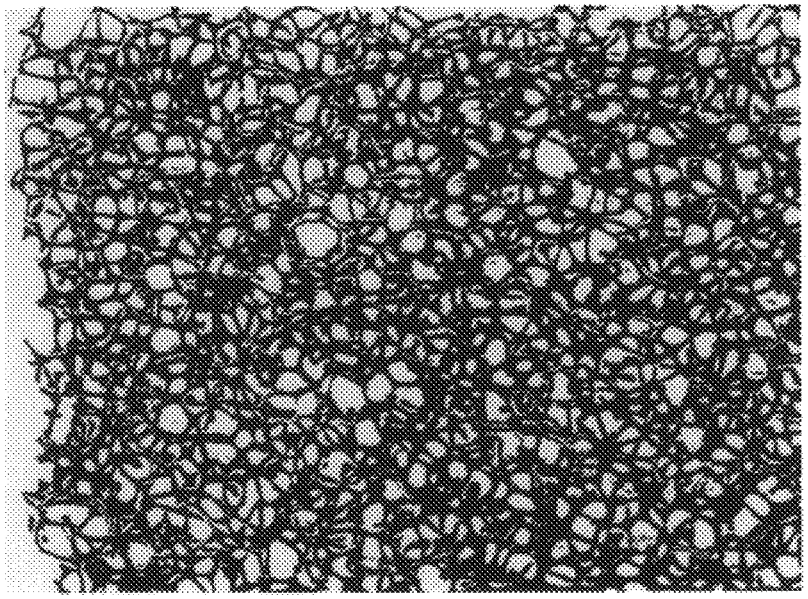
FIG. 11A is a top view illustrating one example in which the cleaning member of the present invention includes a sponge material having expanded intertwined cells with a generally spheric shape.
Figure 11B:
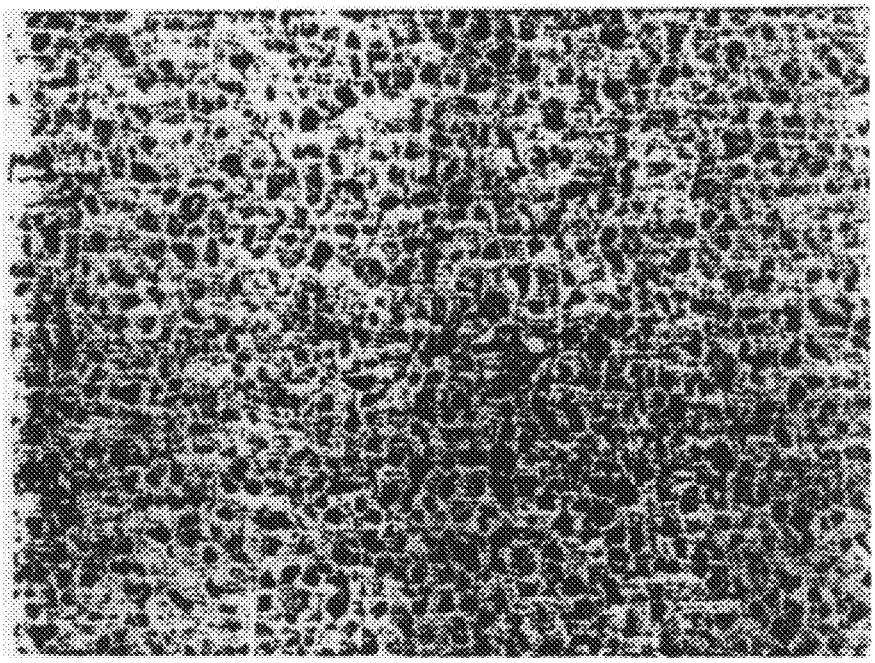
FIG. 11B is a top view illustrating a typical sponge material for comparison with the sponge material shown in FIG. 11A.

In addition, it may be preferable that the sponge roller cleaning member 22 includes expanded intertwined cells having a generally spherical shape, as illustrated in FIG. 11A (i.e., a three-dimensional construction), because the convex portions of the sponge and the convex portions of the charging roller efficiently engage each other, so that the cleaning ability improves. FIG. 11B illustrates a typical sponge material for comparison with the expanded intertwined cells having a generally spherical shape illustrated in FIG. 11A.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No.10-277928 filed in the Japanese Patent Office on Sep. 30, 1998, and Japanese Patent Application No. 11-239809 filed in the Japanese Patent Office on Aug. 26, 1999, the entire contents of which are incorporated by reference.

What is claimed is:

1. An image forming apparatus, comprising:

a rotatable member configured to bear an image;

a charging member configured to charge a surface of the rotatable member and having a plurality of convex portions on a surface of the charging member; and a cleaning member in sliding contact with a surface of the charging member and configured to clean the surface of the charging member, wherein a surface of the cleaning member includes convex portions which engage with convex portions on the surface of the charging member, and wherein a surface hardness of the charging member measured by an Asker C method is set to be greater than a surface hardness of the cleaning member.

2. The image forming apparatus according to claim 1, wherein an average height of the convex portions of the cleaning member is set to be greater than a surface roughness of the charging member based on a ten-point mean surface roughness scale.

3. The image forming apparatus according to claim 1, wherein the cleaning member includes a sponge material.

4. The image forming apparatus according to claim 3, wherein a density of the convex portions of the cleaning member is set to be lower than a density of the convex portions of the charging member.

5. The image forming apparatus according to claim 3, wherein the sponge material of the cleaning member includes expanded intertwined cells having a generally spherical shape.

6. The image forming apparatus according to claim 1, wherein the charging member slidably contacts the rotatable member.

7. The image forming apparatus according to claim 1, wherein the charging member is separated from the rotatable member by 300 $\mu$m or less.

8. An image forming apparatus, comprising:

a rotatable member configured to bear an image;

a charging member configured to charge a surface of the rotatable member; and a cleaning member slidably contacting a surface of the charging member and configured to clean the surface of the charging member, wherein the surface of the charging member includes a surface roughness having a directivity set to a forward direction relative to a rotating direction of the rotatable member and set to a backward direction relative to a surface of the cleaning member, wherein the surface of the cleaning member includes convex portions which engage with convex portions on the surface of the charging member, and wherein a density of the convex portions of the cleaning member is set to be lower than a density of the convex portions of the charging member.

9. The image forming apparatus according to claim 8, wherein the surface roughness of the charging member is in a range of about 5 $\mu$m to about 35 $\mu$m.

10. The image forming apparatus according to claim 8, wherein the cleaning member includes a sponge material.

11. The image forming apparatus according to claim 10, wherein the sponge material of the cleaning member includes expanded intertwined cells having a generally spherical shape.

12. The image forming apparatus according to claim 8, wherein the charging member slidably contacts the rotatable member.

13. The image forming apparatus according to claim 8, wherein the charging member is separated from the rotatable member by 300 $\mu$m or less.

14. An image forming apparatus, comprising:

rotatable means for bearing an image;

means for charging a surface of the rotatable means; and means for cleaning a surface of the charging means, the cleaning means slidably contacting the surface of the charging means, wherein a surface of the cleaning means includes convex portions which engage with convex portions on the surface of the charging means, and wherein a surface hardness of the charging means measured by an Asker C method is set to be greater than a surface hardness of the cleaning means.

15. The image forming apparatus according to claim 14, wherein an average height of the convex portions of the cleaning means is set to be greater than a surface roughness of the charging means based on a ten-point mean surface roughness scale.

16. The image forming apparatus according to claim 14, wherein the cleaning means includes a sponge material.

17. The image forming apparatus according to claim 16, wherein a density of the convex portions of the cleaning means is set to be lower than a density of the convex portions of the charging means.

18. The image forming apparatus according to claim 16, wherein the sponge material of the cleaning means includes expanded intertwined cells having a generally spherical shape.

19. The image forming apparatus according to claim 14, wherein the charging means slidably contacts the rotatable means.

20. The image forming apparatus according to claim 14, wherein the charging means is separated from the rotatable means by 300 $\mu$m or less.

21. An image forming apparatus, comprising:

rotatable means for bearing an image;

means for charging a surface of the rotatable means; and means for cleaning a surface of the charging means, the cleaning means slidably contacting the surface of the charging means, wherein the surface of the charging means includes a surface roughness having a directivity set to a forward direction relative to a rotating direction of the rotatable means and set to a backward direction relative to a surface of the cleaning means, wherein the surface of the cleaning means includes convex portions which engage with convex portions on the surface of the charging means, and wherein a density of the convex portions of the cleaning means is set to be lower than a density of the convex portions of the charging means.

22. The image forming apparatus according to claim 21, wherein the surface roughness of the charging means is in a range of about 5 $\mu$m to about 35 $\mu$m.

23. The image forming apparatus according to claim 21, wherein the cleaning means includes a sponge material.

24. The image forming apparatus according to claim 23, wherein the sponge material of the cleaning means includes expanded intertwined cells having a generally spherical shape.

25. The image forming apparatus according to claim 21, wherein the charging means slidably contacts the rotatable means.

26. The image forming apparatus according to claim 21, wherein the charging means is separated from the rotatable means by 300 $\mu$m or less.

27. A method of forming an image, comprising:

charging a surface of a rotatable member configured to bear an image with a charging member;

forming an image on the rotatable member;

transferring the image formed on the rotatable member to a transfer medium; and cleaning a surface of the charging member with a cleaning member, said cleaning member including convex portions on a surface thereof, which engage with convex portions on the surface of the charging member; and setting a surface hardness of the charging member measured by an Asker C method to be greater than a surface hardness of the cleaning member.

28. The method according to claim 27, further comprising:

setting an average height of the convex portions of the cleaning member to be greater than a surface roughness of the charging member based on a ten-point mean surface roughness scale.

29. The method according to claim 27, wherein the cleaning member includes a sponge material.

30. The method according to claim 29, further comprising:

setting a density of the convex portions of the cleaning member to be lower than a density of the convex portions of the charging member.

31. The method according to claim 29, wherein the sponge material of the cleaning member includes expanded intertwined cells having a generally spherical shape.

32. The method according to claim 27, wherein the charging member slidably contacts the rotatable member.

33. The method according to claim 27, wherein the charging member is separated from the rotatable member by 300 $\mu$m or less.

34. An method of forming an image, comprising:

charging a surface of a rotatable member configured to bear an image with a charging member;

forming an image on the rotatable member;

transferring the image formed on the rotatable member to a transfer medium; and cleaning a surface of the charging member, wherein the surface of the charging member includes a surface roughness having a directivity set to a forward direction relative to a rotating direction of the rotatable member and set to a backward direction relative to a surface of the cleaning member, wherein the surface of the cleaning member includes convex portions which engage with convex portions on the surface of the charging member, and wherein a density of the convex portions of the cleaning member is set to be lower than a density of the convex portions of the charging member.

35. The method according to claim 34, wherein the surface roughness of the charging member is in a range of about 5 $\mu$m to about 35 $\mu$m.

36. The method according to claim 34, wherein the cleaning member includes a sponge material.

37. The method according to claim 36, wherein the sponge material of the cleaning member includes expanded intertwined cells having a generally spherical shape.

38. The method according to claim 34, wherein the charging member slidably contacts the rotatable member.

39. The method according to claim 34, wherein the charging member is separated from the rotatable member by 300 $\mu$m or less.

40. A charging device, comprising:

a charging member configured to charge a surface of a rotatable member and having a plurality of convex portions on a surface of the charging member; and a cleaning member in sliding contact with a surface of the charging member and configured to clean the surface of the charging member, wherein a surface of the cleaning member includes convex portions which engage with convex portions on the surface of the charging member, and wherein a surface hardness of the charging member measured by an Asker C method is set to be greater than a surface hardness of the cleaning member.

41. A charging system, comprising:

means for charging a surface of a rotatable member, the charging means having a plurality of convex portions on a surface thereof; and means for cleaning the surface of the charging means with a cleaning member in sliding contact with the surface of the charging means, wherein a surface of the cleaning member includes convex portions which engage with convex portions on the surface of the charging means, and wherein a surface hardness of the charging means measured by an Asker C method is set to be greater than a surface hardness of the cleaning means.

42. An image forming apparatus, comprising:

a rotatable member configured to bear an image;

a charging member configured to charge a surface of the rotatable member and having a plurality of convex portions on a surface of the charging member; and a cleaning member in sliding contact with a surface of the charging member and configured to clean the surface of the charging member, wherein a surface of the cleaning member includes convex portions which engage with convex portions on the surface of the charging member, wherein the cleaning member includes a sponge material, and wherein a density of the convex portions of the cleaning member is set to be lower than a density of the convex portions of the charging member.

43. An image forming apparatus, comprising:

rotatable means for bearing an image;

means for charging a surface of the rotatable means; and means for cleaning a surface of the charging means, the cleaning means slidably contacting the surface of the charging means, wherein a surface of the cleaning means includes convex portions which engage with convex portions on the surface of the charging means, wherein the cleaning means includes a sponge material, and wherein a density of the convex portions of the cleaning means is set to be lower than a density of the convex portions of the charging means.

44. A method of forming an image, comprising:

charging a surface of a rotatable member configured to bear an image with a charging member;

forming an image on the rotatable member;

transferring the image formed on the rotatable member to a transfer medium; and cleaning a surface of the charging member with a cleaning member, said cleaning member including convex portions on a surface thereof, which engage with convex portions on the surface of the charging member; and setting a density of the convex portions of the cleaning member to be lower than a density of the convex portions of the charging member, wherein the cleaning member includes a sponge material.

45. A charging device, comprising:

a charging member configured to charge a surface of a rotatable member and having a plurality of convex portions on a surface of the charging member; and a cleaning member in sliding contact with a surface of the charging member and configured to clean the surface of the charging member, wherein a surface of the cleaning member includes convex portions which engage with convex portions on the surface of the charging member, wherein the cleaning member includes a sponge material, and wherein a density of the convex portions of the cleaning member is set to be lower than a density of the convex portions of the charging member.

46. A charging system, comprising:

means for charging a surface of a rotatable member, the charging means having a plurality of convex portions on a surface thereof; and means for cleaning the surface of the charging means with a cleaning member in sliding contact with the surface of the charging means, wherein a surface of the cleaning member includes convex portions which engage with convex portions on the surface of the charging means, wherein the cleaning means includes a sponge material, and wherein a density of the convex portions of the cleaning means is set to be lower than a density of the convex portions of the charging means.

47. An image forming apparatus, comprising:

a rotatable member configured to bear an image;

a charging member configured to charge a surface of the rotatable member and having a plurality of convex portions on a surface of the charging member; and a cleaning member in sliding contact with the surface of the charging member and configured to clean the surface of the charging member, wherein a surface of the cleaning member includes convex portions which engage with convex portions on the surface of the charging member, and wherein the cleaning member comprises a sponge material including expanded intertwined cells having a generally spherical shape.

48. An image forming apparatus, comprising:

a rotatable member configured to bear an image;

a charging member configured to charge a surface of the rotatable member; and a cleaning member slidably contacting a surface of the charging member and configured to clean the surface of the charging member, wherein the surface of the charging member includes a surface roughness having a directivity set to a forward direction relative to a rotating direction of the rotatable member and set to a backward direction relative to a surface of the cleaning member, and wherein the cleaning member comprises a sponge material including expanded intertwined cells having a generally spherical shape.

49. An image forming apparatus, comprising:

rotatable means for bearing an image;

means for charging a surface of the rotatable means; and means for cleaning a surface of the charging means, the cleaning means slidably contacting the surface of the charging means, wherein a surface of the cleaning means includes convex portions which engage with convex portions on the surface of the charging means, and wherein the cleaning means comprises a sponge material including expanded intertwined cells having a generally spherical shape.

50. An image forming apparatus, comprising:

rotatable means for bearing an image;

means for charging a surface of the rotatable means; and means for cleaning a surface of the charging means, the cleaning means slidably contacting the surface of the charging means, wherein the surface of the charging means includes a surface roughness having a directivity set to a forward direction relative to a rotating direction of the rotatable means and set to a backward direction relative to a surface of the cleaning means, and wherein the cleaning means comprises a sponge material including expanded intertwined cells having a generally spherical shape.

51. A method of forming an image, comprising:

charging a surface of a rotatable member configured to bear an image with a charging member;

forming an image on the rotatable member;

transferring the image formed on the rotatable member to a transfer medium; and cleaning a surface of the charging member with a cleaning member, said cleaning member including convex portions on a surface thereof, which engage with convex portions on the surface of the charging member, and wherein the cleaning member comprises a sponge material including expanded intertwined cells having a generally spherical shape.

52. An method of forming an image, comprising:

charging a surface of a rotatable member configured to bear an image with a charging member;

forming an image on the rotatable member;

transferring the image formed on the rotatable member to a transfer medium; and cleaning a surface of the charging member, wherein the surface of the charging member includes a surface roughness having a directivity set to a forward direction relative to a rotating direction of the rotatable member and set to a backward direction relative to a surface of the cleaning member, and wherein the cleaning member comprises a sponge material including expanded intertwined cells having a generally spherical shape.

53. A charging device, comprising:

a charging member configured to charge a surface of a rotatable member and having a plurality of convex portions on a surface of the charging member; and a cleaning member in sliding contact with the surface of the charging member and configured to clean the surface of the charging member, wherein a surface of the cleaning member includes convex portions which engage with convex portions on the surface of the charging member, and wherein the cleaning member comprises a sponge material including expanded intertwined cells having a generally spherical shape.

54. A charging system, comprising:

means for charging a surface of a rotatable member, the charging means having a plurality of convex portions on a surface thereof; and means for cleaning the surface of the charging means with a cleaning member in sliding contact with the surface of the charging means, wherein a surface of the cleaning member includes convex portions which engage with convex portions on the surface of the charging means, and wherein the cleaning means comprises a sponge material including expanded intertwined cells having a generally spherical shape.

* * * * *